US005166650A

United States Patent [19]

Simmons et al.

[11] Patent Number: 5,166,650

[45] Date of Patent: Nov. 24, 1992

[54] REMOTE WAVEGUIDE FLANGE CLAMP

[75] Inventors: James A. Simmons, Livermore; Greggory R. Hansen, Lafayette, both of Calif.

[73] Assignee: Loral Aerospace Corp., New York, N.Y.

[21] Appl. No.: 735,867

[22] Filed: Jul. 25, 1991

[51] Int. Cl.[5] ..... H01P 1/04

[52] U.S. Cl. ..... 333/254; 285/364; 285/920; 333/255

[58] Field of Search ..... 333/254, 255; 285/320, 285/364, 406, 920; 403/335, 338; 439/38, 372

[56] References Cited

U.S. PATENT DOCUMENTS

| | | | |
|---|---|---|---|
| 1,232,436 | 7/1917 | Scritchfield | 285/320 X |
| 2,536,602 | 1/1951 | Goett | 285/129 |
| 2,548,404 | 4/1951 | Sobel et al. | 285/143 |
| 2,643,139 | 6/1953 | Hamilton | 285/129 |
| 2,738,207 | 3/1956 | Twigg, Jr. | 285/129 |
| 3,005,968 | 10/1961 | Jones et al. . | |
| 3,076,159 | 1/1963 | Vaughn et al. . | |
| 3,076,948 | 2/1963 | Misner . | |
| 3,383,633 | 5/1968 | Havlicksek et al. . | |
| 4,183,189 | 1/1980 | Keller et al. | 52/637 |
| 4,514,708 | 4/1985 | Ludtke | 333/255 |
| 4,768,006 | 8/1988 | Trift et al. | 333/255 |
| 4,884,046 | 11/1989 | Spinner | 333/255 X |
| 5,060,989 | 10/1991 | Gallucci et al. | 285/320 X |

FOREIGN PATENT DOCUMENTS

| | | | |
|---|---|---|---|
| 1100748 | 8/1957 | Fed. Rep. of Germany | 333/254 |

*Primary Examiner*—Paul Gensler

*Attorney, Agent, or Firm*—Dennis S. Fernandez; Kenneth M. Kaslow; Edward J. Radlo

[57] ABSTRACT

A remote waveguide flange clamp system (10, 11) detachably connects a first waveguide section (20) to a second waveguide section (30, 37). System (10, 11) is controlled remotely by a controller (60). A pair of elongated clamping levers (40) is mounted pivotally to pins (42) on bracket arms (39) of section (30, 37). Levers (40) rotate about pins (42) when a motor assembly (51) moves driving ends (47) of levers (40) outwardly or inwardly relative to section (30, 37). When ends (47) move outwardly, clamping ends (44) of levers (40) apply a compressive force to flanges (22, 32) of sections (20, 30) to provide a gasketed seal (80) inhibiting RF leakage therebetween. Assembly (51) includes a torque sensor (66) for continuously applying current to a motor (50) in assembly (51) until sensor (66) measures current substantially equaling a predefined value. When sensor (66) measures current substantially equaling the value, a fail-safe brake mechanism (56) is engaged to prevent further rotation of a shaft (52) in motor (50).

15 Claims, 4 Drawing Sheets

REMOTE WAVEGUIDE FLANGE CLAMP

DESCRIPTION

1. Technical Field

The invention relates to devices for fastening members together, and particularly to clamps for fastening waveguide flanges.

2. Background Art

Waveguides are metal pipes that channel electromagnetic waves. These pipes are used in most radar, satellite communications, and related systems. In such systems, separate waveguide sections are connected detachably to facilitate maintenance and testing. When the systems are enclosed in compact racks or chassis, however, waveguide sections are sometimes positioned in inaccessible areas. In these areas, waveguide sections are difficult to connect to or detach from other waveguide sections. Thus, in such areas, previous devices for connecting waveguides are not easily operable.

In addition, systems that transmit signals at Radio Frequencies (RF) typically channel wave energies exceeding a few kilowatts. At these high energy levels, RF signals may leak from the connections between waveguide sections. RF leakage may undesirably attenuate the signals, adversely affect nearby electronic equipment, and pose a health hazard to nearby personnel. This leakage is inhibited by forming a tight, gasketed seal between the connected sections. Forming such a seal requires that the sections be clamped together with sufficient compressive forces, typically exceeding 2,000 pounds. Previous devices for connecting waveguides do not apply this amount of compressive force.

Previous devices for connecting waveguides include: U.S. Pat. No. 2,548,404 to Sobel et al. for a waveguide clip; U.S. Pat. No. 2,643,139 to Hamilton for a quickly-operable conduit clamp; U.S. Pat. No. 2,738,207 to Twigg for a waveguide coupling clamp with spring aligning means; U.S. Pat. No. 3,005,968 to Jones et al. for a clamping device for testing waveguides; U.S. Pat. No. 3,076,159 to Vaughan et al. for a waveguide coupling apparatus; U.S. Pat. No. 3,076,948 to Misner for a quick-disconnect device for waveguide flanges; U.S. Pat. No. 4,514,708 to Ludtke for a quick-disconnect waveguide locking mechanism; and U.S. Pat. No. 3,383,633 to Havlicsek et al. for an automatic quick-opening waveguide closure.

Other related devices for connecting non-waveguide conduits include: U.S. Pat. No. 4,183,189 to Keller et al. for a flange connector (for offshore drilling structures); and U.S. Pat. No. 2,536,602 to Goett for an automatic flange system (for pipe plumbing).

DISCLOSURE OF INVENTION

The invention is an apparatus (10, 11) for detachably connecting a first waveguide section (20) having a first flange (22) to a second waveguide section (30, 37) having a second flange (32). Apparatus (10, 11) comprises a first elongated clamping member (40), which has a first clamping end (44) and a first driving end (47), and which is connected pivotally between such ends (44, 47) to the second section (30, 37) about a first pivotal axis (42) having an offset from the second section (30, 37); and motive means (51) coupled to the second section (30, 37) and the first driving end (47) for moving the first driving end (47) outwardly relative to the second section (30, 37), the outward movement causing the first member (40) to rotate about the first pivotal axis (42) for causing the first clamping end (44) to engage the second section (30, 37) by applying a compressive force to the first and second flanges (22, 32), the compression thereby inhibiting RF leakage in a gasketed connection (80) between the first section (20) and the second section (30, 37).

BEST MODE FOR CARRYING OUT THE INVENTION

Figures 1, 2:
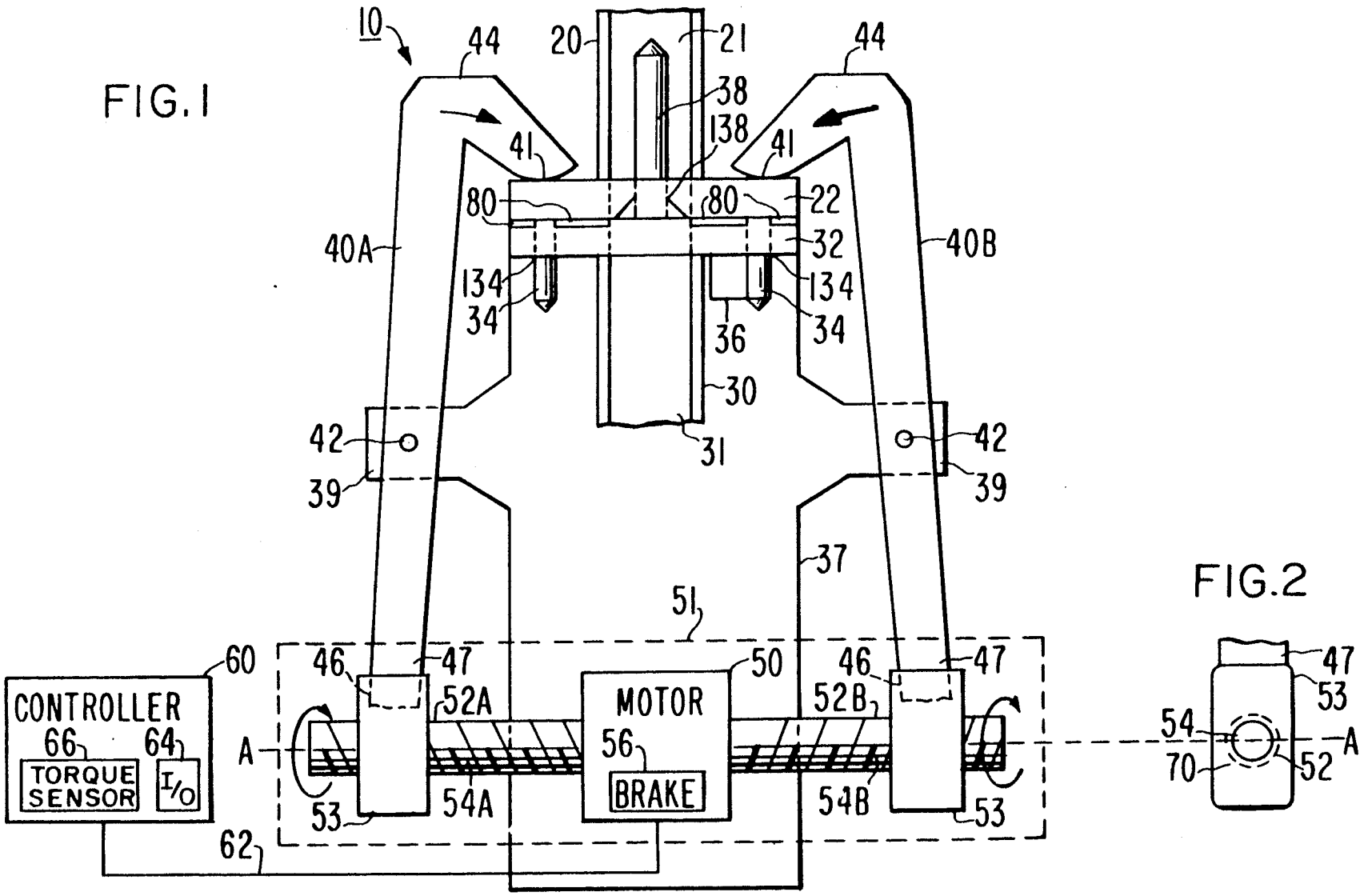
FIG. 1 is a diagram of a remote waveguide flange clamp system (10) for detachably connecting a movable waveguide section (20) to a stationary waveguide section (30). System (10) is controlled remotely by a controller (60).
FIG. 2 is a side view of a portion of system (10) showing a coupling (53) between a clamping lever (40) and a motor shaft (52).

FIG. 1 shows a remote waveguide flange clamp system 10 for connecting a first waveguide section 20 to a second waveguide section 30. Section 20 is movable relative to section 30 which is stationary within system 10. System 10 is controlled remotely by a controller 60. System 10 serves to connect sections 20, 30 detachably in compact locations where connecting and detaching of sections 20, 30 would normally be difficult or impossible. System 10 applies a sufficient compressive force to sections 20, 30 to inhibit RF leakage from a gasketed connection therebetween.

Section 20 includes a flange 22 and a waveguide channel 21. Similarly to section 20, section 30 includes a flange 32 and a waveguide channel 31. Section 30 is integrated rigidly within a waveguide housing 37. Flanges 22, 32 are secured rigidly to the ends of section 20, 30 where channels 21, 31 terminate openly. As conventional for gasketed waveguide connections, flanges 22, 32 extend outwardly from sections 20, 30 to facilitate the clamping or fastening of flanges 22, 32. Channels 21, 31 are illustrated in part to show the connected portions of sections 20, 30. Sections 20, 30 are constructed of metal piping which is suitable for containing electromagnetic wave energy. Alternatively, channels 21, 31 may be employed as conduits for conveying a gaseous or liquified medium under pressure through sections 20, 30.

A gasket 80 that is composed of conductive or metal-bearing elastomer is disposed between flanges 22, 32 to fill voids and prevent RF leakage therein when sections 20, 30 are sufficiently compressed together. Gasket 80 is provided with suitable openings for receiving alignment pins 34 which extend from flange 22.

When connected together, sections 20, 30 operate to channel electromagnetic waves through channels 21, 31. The cross-sections of channels 21, 31 are dimensioned in a conventional manner to propagate waves therein of a given frequency. Although channels 21, 31 are each dimensioned with a rectangular cross section, channels 21, 31 having circular cross-sections may also be employed. In addition, the cross-sections of channels 21, 31 and flanges 22, 32 are shaped identically to permit mating of sections 20, 30. Standardized cross-sectional dimensions are defined for waveguide channels 21, 31 operating over pre-defined frequency bands, i.e., WR-112 rectangular waveguide for 7,050–10,000 MHz, and WR-137 rectangular waveguide for 5,850–8,200 MHz.

Sections 20, 30 are connected by a pair of clamping levers 40 which apply a force to compress flanges 22, 32 together. The compressive force is produced as levers 40 rotate symmetrically relative to section 20, 30. Lever 40A is disposed to the left of sections 20, 30, and lever 40B is disposed to the right of sections 20, 30. To apply compressive force, lever 40A rotates clockwise, and lever 40B rotates counter-clockwise. Levers 40 are elongated members each having a clamping end 44 and a driving end 47. Clamping ends 44 are hook or U-shaped and have an extended tip 41 for contacting flange 22 compressively. The shape and extension of ends 44 facilitate the connection and detachment of sections 20, 30 in compact locations.

Approximately midway between ends 44, 47, each lever 40 is mounted pivotally to a pivot pin 42. Each pin 42 is positioned on a bracket arm 39 which is connected integrally to housing 37 at opposing sides of section 30. Pins 42 function as fulcrum supports about which levers 40 turn. Arms 39 extend from housing 37 to offset laterally the pivotal axes of pins 42 from section 30. In particular, such offset serves to position each axis distally to provide substantial lateral spacing between each axis and the point on flange 22 where tips 41 contact flange 22. This offset also positions each axis proximately relative to housing 37 to prevent arms 39 from occupying excessive lateral space. This proximate positioning allows system 10 to be installed in compact locations. Additionally, because of this offset, tips 41 contact flange 22 when levers 40 rotate about pins 42 and ends 44 approach section 30.

Levers 40 are rotated inwardly or outwardly by directional actuation of a motor assembly 51 which is connected securely to housing 37. Assembly 51 includes a pair of mechanical couplings 53 for rotating levers 40. Couplings 53 are coupled to ends 47 of levers 40 and move such ends 47 outwardly or inwardly relative to housing 37. Assembly 51 includes a motor 50 for driving a shaft 52 which is connected to couplings 53. Couplings 53 move translationally, i.e., left or right, in response to rotation of shaft 52. Shaft 52 may also be driven by a mechanical lever or a hydraulic or pneumatic system for transforming liquid or gas pressure to rotational mechanical energy.

Shaft 52 extends from both sides of motor 50 and rotates about an axis A—A. Shaft 52A extends from the left side of motor 50 and is threaded with a leadscrew or wormgear 54A. Shaft 52B extends from the right side of motor 50 and is threaded with a leadscrew or wormgear 54B. Wormgears 54A and 54B are cut with similar pitch in opposite rotation directions.

FIG. 2 shows a side view of end 47 of lever 40 and couplings 53, as aligned with axis A—A. A sleeve opening 70 is disposed at each coupling 53 to receive shaft 52. Opening 70 is threaded internally to engage wormgear 54 when shaft 52 rotates. Ends 47 are slidably received in apertures 46 disposed in each coupling 53. Ends 47 are received in apertures 46 at varying angles as couplings 53 move translationally.

When motor 50 drives shaft 52 to rotate in the direction indicated by the arrows shown at the ends of shaft 52, couplings 53 move away from each other to cause ends 47 of levers 40 to move outwardly from housing 37. When shaft 52 is driven to rotate in the opposite direction, couplings 53 move toward each other to cause ends 47 to move inwardly toward housing 37. These movements of couplings 53 are determined by the directions of rotation or shaft 52 and by the pitches of wormgears 54 A, B.

Outward movement of ends 47 causes levers 40 to rotate about pins 42 in the directions indicated by the arrows shown at ends 44. These rotations cause tips 41 of ends 44 to contact flange 22. Preferably, tips 41 contact flange 22 simultaneously and symmetrically to apply compressive forces evenly. Inward movement of ends 47 causes levers 40 to rotate about pins 42 in the direction which is opposite to that indicated by the arrows shown at ends 44. These rotations cause tips 41 of ends 44 to lift away from flange 22 simultaneously and symmetrically.

Figure 4:
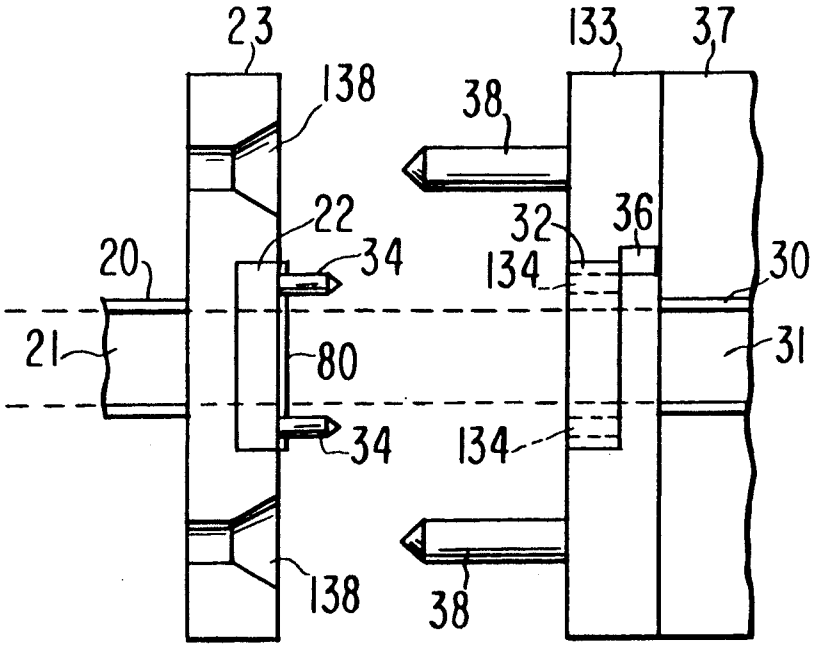
FIG. 4 is a side view of the mating portions of sections (20, 30.)

As can be seen in FIG. 4, mating of sections 20, 30 is facilitated by using a plurality of alignment pins 34, 38. Pins 34 extend from flange 22 and are received in openings 134 in flange 32. Pins 38 extend from flange extension 133 of flange 32 and are received in openings 138 in flange extension 23 of flange 22. Preferably, pins 38 are longer and larger in diameter than pins 34. This difference in pin size allows pins 38 to provide initial, rough alignment to guide sections 20, 30 as flanges 22, 32 first approach and contact each other. In addition, such difference allows pins 34 to provide subsequent, fine alignment of flanges 22, 32. Openings 138 are bevelled, and the ends of pins 34, 38 are tapered to ease self-alignment of flanges 22, 32.

Figure 3:
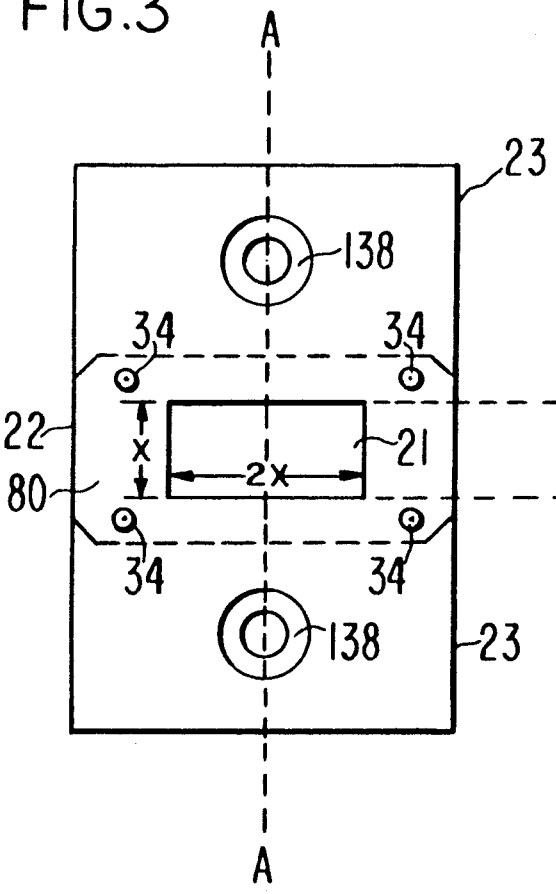
FIG. 3 is a cross-sectional view of flange (22) oriented along line A—A.

In FIG. 3 a cross-sectional view of flange 22 is shown, as oriented along line A—A. Channel 21 is shown having rectangular cross-sectional dimensions, typically of 2X by X. Four pins 34 are shown, one on each corner of flange 22. Flange extensions 23 are coupled integrally to flange 22 and include a pair of openings 138 for receiving a pair of pins 38. In FIG. 4, a side view of the mating portions of sections 20, 30 is shown, as aligned with the cross-sectional view of flange 22 in FIG. 3.

A contact switch 36 is connected to the interior side of flange 32. Switch 36 detects full insertion of at least one of pins 34 into openings 134. Switch 36 is connected to controller 60 to restrict operation of motor 50 upon such detection of full insertion of pins 34 into openings 134.

Controller 60 is connected to motor 50 through a remote communications link 62. Controller 60. includes a torque sensor 66 and an input/output device 64. Device 64 conveys information to indicate various conditions of flanges 22, 32 and levers 40. Flanges 22, 32 may be in a disengaged, an engaged, or a locked condition. Levers 40 may be in an opened or a closed condition. Device 64 allows a user to enter commands for operating the switching of system 10 in a conventional manner to produce such conditions.

Prior to operation of system 10, device 64 indicates that flanges 22, 32 are in the disengaged condition and levers 40 are in the opened condition. Under these conditions, system 10 is in an unclamp mode. In this mode, ends 44 of levers 40 are disengaged from flange 22 and ends 47 ar positioned adjacently to housing 37. Thus, system 10 is available for receiving or detaching section 20.

To operate system 10, section 20 is positioned in alignment with section 30. Mating is accomplished by initially inserting pins 38 into openings 138 and then inserting pins 34 into opening 134. When switch 36 detects full insertion of pins 34, device 64 indicates that flanges 22, 32 are in the engaged condition. Only during this condition will controller 60 permit the user to operate levers 40 into the closed condition This restriction on switching condition is a safety precaution to prevent levers 40 from accidentally applying a compressive force to flanges 22, 32 particularly when sections 20, 30 are not yet properly mated. Moreover, this restriction prevents levers 40 from being operated to close accidentally while tips 41 are positioned between flanges 22, 32.

When the user enters a command into device 64 to operate levers 40 into the closed condition, controller 60 applies drive current to motor 50. Motor 50 drives shaft 52 to rotate in the direction indicated by the arrows at the ends of shaft 52. This rotation causes ends 47 to move outwardly from housing 37. Levers 40 rotate about pins 42 in the direction indicated by the arrows at ends 44 causing tips 41 to apply a compressive force on flanges 22, 32.

Torque sensor 66 in controller 60 measures the amount of current applied to drive motor 50. In a feedback arrangement between controller 60 and motor 50, sensor 66 causes controller 60 to continue to apply current until sensor 66 measures a current amount that substantially equals a predefined current value. This value corresponds to a particular amount of torque applied by motor 50 to rotate shaft 52. More importantly, this value also corresponds to a particular compressive force applied by levers 40 to clamp flanges 22, 32 to form a gasketed seal 80 therebetween. In a preferred embodiment, this value corresponds to a compressive force of at least 2,000 pounds.

The correspondence between applied current and compressive force is established by calibrating system 10 with a common strain gauge (not shown). The gauge measures the compression forces actually applied by sensor 66 at various drive currents. Thus, through regular calibration of system 10, sensor 66 accurately measures the drive current applied to motor 50. This ensures that routine mechanical wear of flanges 22, 32 or tips 41 does not reduce the compressive pressures applied thereto.

Once sensor 66 measures a current amount substantially equal to the predefined value, controller 60 engages a fail-safe brake mechanism 56 to prevent further rotation of shaft 52. When mechanism 56 is engaged, device 64 displays that flanges 22, 32 are in a locked condition and levers 40 are in a closed condition. Under these conditions, system 10 is mechanically fixed in a clamp mode. In this mode, a gasket-type seal 80 is formed between sections 20, 30 which is sufficiently tight to inhibit RF leakage. Moreover, the seal is preserved even during a power failure since mechanism 56 locks shaft 52 with a ratchet-type, fail-safe brake.

To detach sections 20, 30, the user enters a command into device 64 to operate levers 40 into the opened condition. This operation causes controller 60 to unlock mechanism 56. Once mechanism 56 is unlocked, controller 60 applies current to drive motor 50 to rotate shaft 52 in the direction which is opposite from the direction indicated by the arrows at the ends of shaft 52. This rotation in the opposite direction moves ends 47 inwardly toward housing 37. Levers 40 rotate about pins 42 with ends 44 moving away from section 30 in the direction opposite to that indicated by the arrows shown on ends 44. This movement disengages tips 41 from flange 22. Section 20 can thus be removed freely from section 30. When switch 36 detects that pins 34 are no longer fully inserted into openings 134, device 64 indicates that flanges 22, 32 are in the disengaged condition and levers are in the opened condition.

Figure 5:
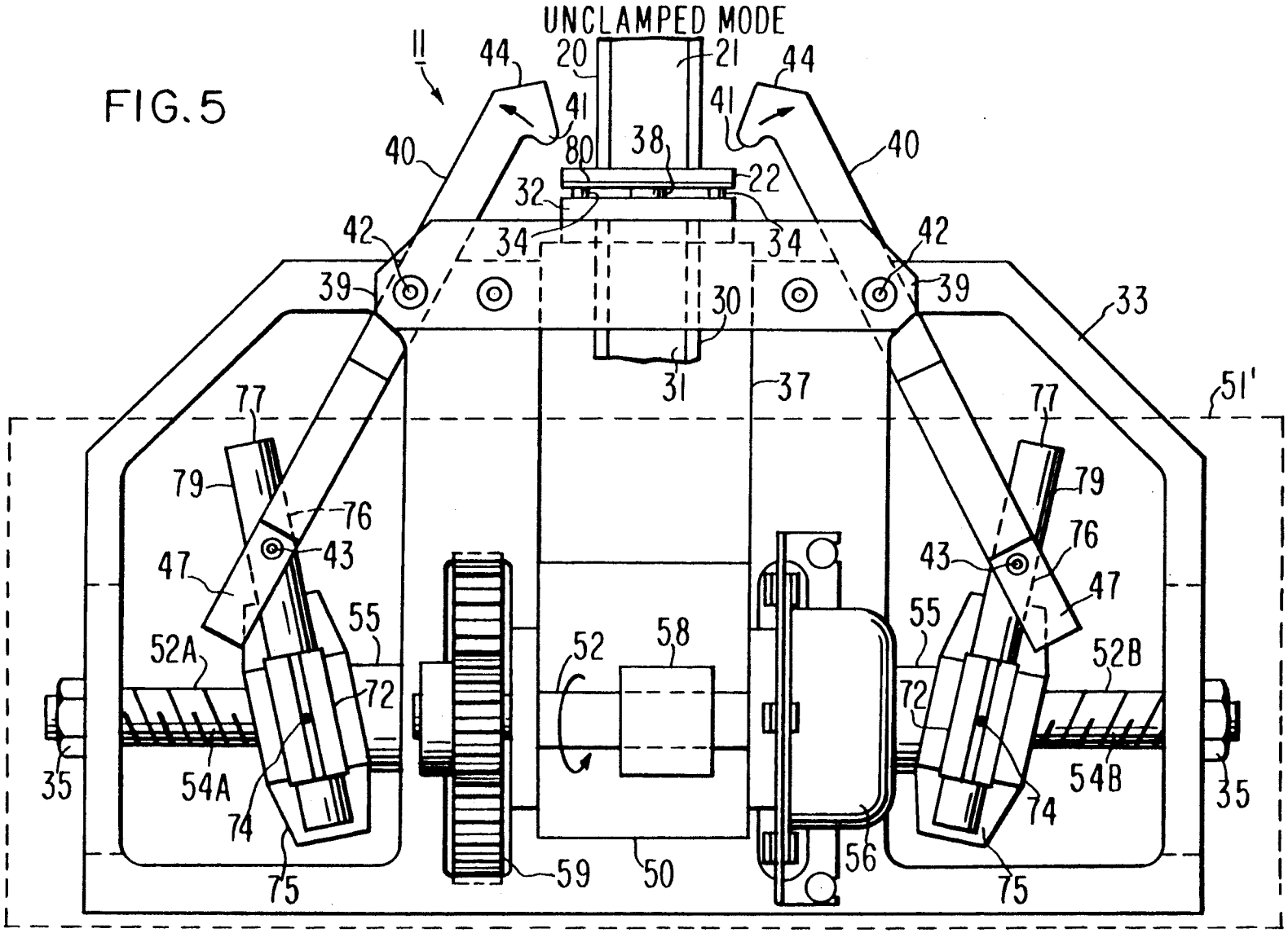
FIG. 5 is a diagram of an alternative flange clamp system (11) showing an alternative motor assembly (51'). System (11) is shown in an unclamp mode.
Figure 6:
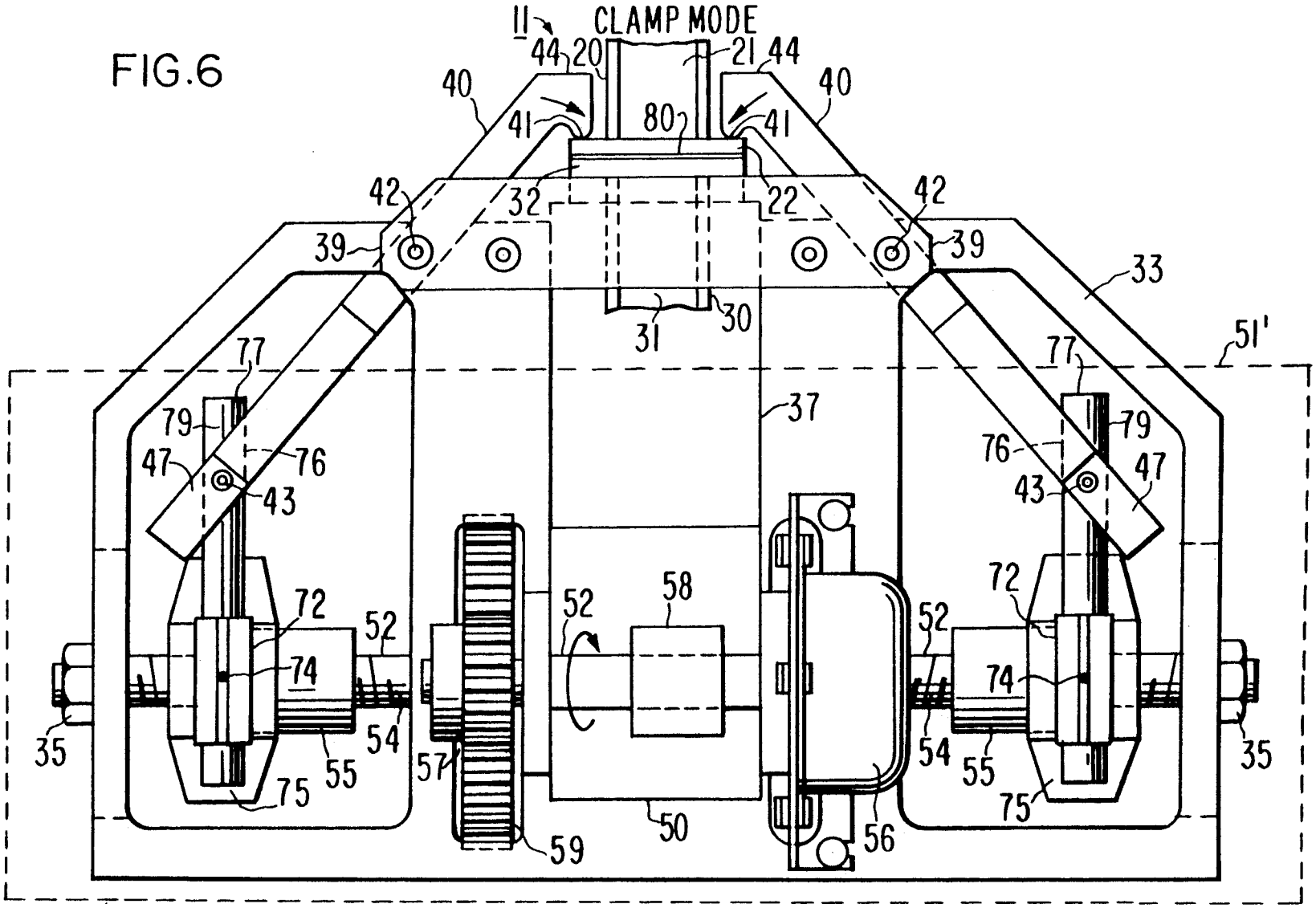
FIG. 6 is a diagram of system (11) shown in a clamp mode.

An alternative flange clamp system 11 is shown in FIG. 5 in the unclamp mode, and in FIG. 6 in the clamp mode. Controller 60 is omitted from FIGS. 5 and 6, although it controls system 11 in the same manner as in system 10. Similarly to system 10, system 11 detachably connects sections 20, 30 by rotating levers 40 to clamp flanges 22, 32. Sufficient compressive force is applied by levers 40 to create a gasketed seal which inhibits RF leakage therebetween. As in system 10, levers 40 in system 11 are mounted pivotally to pins 42 on arms 39. Arms 39 are offset laterally from housing 37. Additional bracket arms 33 are coupled to arms 39 to enclose system 11 structurally. Bolts 35 couple the ends of shaft 52 to arms 33 for improved structural support of shaft 52.

An alternative motor assembly 51, includes a main drive gear 59 which couples motor 50 to shaft 52. A pinion gear (not shown) positioned behind gear 59 may couple motor 50 to gear 59. A mechanical phase adjuster 58 is coupled to shaft 52 for aligning the angular phase of wormgear 54A to that of wormgear 54B. Adjuster 58 serves to ensure that tips 41 engage flange 22 simultaneously and symmetically. Fail-safe brake mechanism 56 is shown coupled to shaft 52. Assembly 51, may be used in system 10 as in system 11 for essentially the same function as for assembly 51.

Similarly to system 10, which uses couplings 53 to couple ends 47 of levers 40 to shaft 52, system 11 uses ball-nut assemblies 55 and linear bearings 72 for essentially the same purpose as that of couplings 53. A set of assembly 55 and bearing 72 is arranged on each side of housing 37. Assemblies 55 are threaded internally for engaging wormgear 54 on shaft 52. This engagement allows assemblies 55 to move translationally, i.e., left or right, when shaft 52 rotates.

Bearings 72 slidably receive elongated members or shafts 79. Each shaft 79 has an upper end 77 and a lower end 75. Near its end 77, each shaft 79 is received in cylindrical opening 76 in lever 40. Shaft 79 is rigidly fixed to end 47 of lever 40 by a ser screw 43. As a result, the angular displacement between lever 40 and shaft 79 is set to a desired angle.

Ends 75 of shafts 79 are slidably received in bearings 72, which are in turn mounted pivotally on pivot pins 74 which are connected to assemblies 55. The slidable reception of ends 75 permits shafts 79 to move linearly through bearings 72. Thus, shafts 79 may slide but not "wobble" when moving through bearings 72.

In FIG. 5, system 11 is shown in the unclamp mode. In this mode, section 20 is detachable from and connectable to section 30. Tips 41 are disengaged from flange 22 as ends 44 are lifted away from section 30. Assembly 51' causes shaft 52 to rotate in the direction indicated by the arrow shown midway on shaft 52. This rotation moves assemblies 55 inwardly toward housing 37. This movement causes ends 75 of bearings 72 to move inwardly with assemblies 55. As bearings 72 move inwardly, ends 75 of shaft 79 move with bearings 72. As a result, ends 75 slide in through bearings 72, and bearings 72 rotate about pins 74, thereby moving ends 77 away from housing 37.

In FIG. 6, system 11 is shown in the clamp mode. In this mode, section 20 is connected to section 30. Tips 41 contact flange 22 as ends 44 rotate toward section 30. Assembly 51' causes shaft 52 to rotate in the direction indicated by the arrow shown midway on shaft 52. This rotation moves assemblies 55 outwardly from housing 37. This movement causes ends 75 of shafts 79 to move outwardly with assemblies 55. As shafts 79 move outwardly, ends 47 of levers 40 move with shafts 79. Ends 75 of shafts 79 slide out partially from bearings 72 in assembly 55, and bearings 72 rotate about pins 74 to move ends 77 toward housing 37.

We claim:

1. An apparatus for detachably connecting a first section of a waveguide having a first flange to a second section of the waveguide having a second flange, the apparatus comprising:

a first elongated clamping member, having a first clamping end and a first driving end, pivotally connected between such ends to the second section about a first pivotal axis having an offset from the second section;

a shaft coupled to the first driving end of the clamping member and having a wormgear which is cut threadably to move the first driving end in a translational direction when the shaft rotates; and a motor coupled to the shaft and in fixed relation to the second section, for causing the shaft to rotate and thus moving the first driving end outwardly relative to the second section, the outward movement causing the first member to rotate about the first pivotal axis, the rotation causing the first clamping end to engage the first section and apply a compressive force which pushes the first flange into sealing contact with the second flange for connecting the first and second sections such that RF leakage between the first and second sections is inhibited.

2. The apparatus in claim 1, wherein the clamping end of the first member includes a U-shaped tip for engaging the second section.

3. The apparatus in claim 1, further comprising:

a second elongated clamping member, having a second clamping end and a second driving end, pivotally connected between such ends to the second section about a second pivotal axis having an offset from the second section;

and wherein the shaft is further coupled to the second driving end for moving the second driving end outwardly relative to the second section, the outward movement causing the second member to rotate about the second pivotal axis, the rotation causing the second clamping end to engage the first section and apply a compressive force which pushes the first flange into sealing contact with the second flange for connecting the first and second sections.

4. The apparatus in claim 3, wherein the first and second members rotate respectively about the first and second pivotal axes simultaneously and symmetrically to apply compressive force evenly to the first and second flanges.

5. The apparatus in claim 1, wherein the first pivotal axis is positioned distally from the second section on a bracket arm which is connected integrally to the second section.

6. The apparatus in claim 1, wherein the shaft rotates in the opposite direction and moves the first driving end inwardly relative to the second section, the inward movement causing the first member to rotate about the first pivotal axis, the rotation causing the first clamping end to lift away from the first section, the lifting permitting the first section to be detached from the second section.

7. The apparatus in claim 1, wherein the shaft is received in a ball-nut assembly which threadably engages the wormgear of the shaft to move the assembly translationally along the shaft, the assembly being pivotally connected to an elongated linear bearing, the bearing being connected to the first driving end of the first member.

8. The apparatus in claim 7, wherein the angular displacement between the first member and the bearing is set to a desired angle.

9. The apparatus in claim 1, further comprising a controller for permitting a user to enter commands for remotely controlling the motor to connect and detach the first section to and from the second section.

10. The apparatus in claim 9, wherein the controller applies current to the motor for rotating the shaft in a desired direction.

11. The apparatus in claim 10, wherein the controller includes a torque sensor which is coupled to the motor in a feedback arrangement, the sensor measuring the amount of the current applied and causing the controller to continue to apply current until the sensor measures current substantially equal to a predefined value.

12. The apparatus in claim 11, further comprising a fail-safe brake mechanism coupled to the motor for preventing further rotation of the shaft in response to the sensor measuring the current substantially equal to the predefined value.

13. The apparatus in claim 9, further comprising:

a contact switch, coupled to the controller and the second flange; and an alignment pin, coupled to the first flange;

wherein the alignment pin extends from the first flange and is received in an opening in the second flange when the first and second sections are connected, the switch detecting full insertion of the alignment pin in the opening, the controller limiting operation of the motor in response to the switch detecting full insertion.

14. The apparatus in claim 13, wherein the alignment pin is tapered to ease self-alignment of the first and second flanges.

15. The apparatus in claim 13, further comprising:

at least one guide pin, coupled to the second flange;

wherein each guide pin extends from the second flange and is each received in a corresponding opening in the first flange when the first and second sections are connected, each guide pin being longer than the alignment pin and each corresponding opening being bevelled to ease alignment.

* * * * *